United States Patent [19]

Rehbein

[11] 4,159,849

[45] Jul. 3, 1979

[54] HOLDING DEVICE FOR A CHAIN

[75] Inventor: Friedhelm Rehbein, Menden-Oesbern, Fed. Rep. of Germany

[73] Assignee: Fa. August Thiele, Iserlohn, Fed. Rep. of Germany

[21] Appl. No.: 820,128

[22] Filed: Jul. 29, 1977

[30] Foreign Application Priority Data

Sep. 25, 1976 [DE] Fed. Rep. of Germany ..... 2643264

[51] Int. Cl.[2] ..... E21C 29/06

[52] U.S. Cl. ..... 299/34; 24/116 R

[58] Field of Search ..... 24/116; 299/34, 42, 299/43

[56] References Cited

U.S. PATENT DOCUMENTS

| | | | |
|---|---|---|---|
| 1,051,230 | 1/1913 | Holman | 24/116 R |
| 2,448,482 | 8/1948 | Woolslayer et al. | 24/116 R |
| 2,652,018 | 9/1953 | Griffith | 24/116 R |

FOREIGN PATENT DOCUMENTS

| | | | |
|---|---|---|---|
| 1375981 | 9/1963 | France | 299/34 |
| 1433248 | 7/1964 | France | 299/34 |

*Primary Examiner*—William Pate, III

*Attorney, Agent, or Firm*—Michael J. Striker

[57] ABSTRACT

A holding device for a chain is proposed, particularly for a chain associated with a coal cutter and having links located in two mutually transverse planes. The holding device has a chain block having two portions formed with a recess and bounding a slot. The recess is dimensioned for receiving an end portion of one of the chain links which is located in one of the planes, and the slot is dimensioned for receiving the other chain link which is located in the other of the planes. The recess may be U-shaped, and the slot extends in the direction of elongation of the chain block. Supporting portions may be provided for supporting one of the chain links which is located in a horizontal plane. Means may be provided for fastening the horizontal chain link to the supporting portions. Two additional such portions may be provided in the same chain block, spaced from the first two portions in the direction of elongation of the chain block. The slots of the two pairs of portions may be formed as a common slot extending in the direction of elongation of the chain block and bounded between the above portions and the supporting portions.

20 Claims, 6 Drawing Figures

HOLDING DEVICE FOR A CHAIN

BACKGROUND OF THE INVENTION

The present invention relates to a holding device for a chain, particularly for a chain associated with a coal cutter.

Chain blocks for holding chains have been proposed in the art, which blocks are formed as massive elongated rectangular-shaped members of steel, and are of a welded or forged construction. The shaped member is provided with a chain holding dog extending laterally beyond the shaped member. An end link of the chain or a longitudinal element of a chain swivel is suspended on the above dog. A mounting lug or another mounting dog is arranged at the other end of a body part of the coal cutter, for a guide bar or for a safety chain. The guide bar or the safety chain serve for connecting the chain block with another chain block which is provided at the other end of the coal cutter.

Practical use of the above device has shown that the chain holding dogs are frequently torn off under stresses applied thereto under extreme geological conditions, especially in the case of steep stratification, in spite of the fact that they are extremely massively mounted on blocks of coal cutter tongues. When the chain is torn off at a downstream location (relative to the machine), it is no longer in control, due to its own weight and due to the pulling force acting upon it after it tears away from the chain holding dogs. Thus, the torn off end portions of the chain must be located in the mine and returned to the chain block. Furthermore, the projecting portions of the chain holding dogs endanger safety in the mine. Moreover, forged links located between outer portions and middle portions of the coal cutter are destroyed as often as the chain holding dogs are torn off. After this it is not possible to withdraw the coal cutter with the desired degree of mobility.

SUMMARY OF THE INVENTION

Accordingly, it is an object of the present invention to provide a holding device for a chain which avoids the disadvantages of the prior art.

More particularly, it is an object of the present invention to provide a holding device for a chain, which provides for better supporting and holding of elements of the chain than the prior art holding devices.

Another feature of the present invention is to provide a holding device for a chain which can reliably receive and guide elements of the chain.

In keeping with these objects, and with others, which will become apparent hereinafter, one feature of the present invention resides, briefly stated, in a holding device for a chain having members located in two mutually transverse planes, which holding device has a chain block mounted on a support and having two portions formed with a recess for receiving an end portion of one of the chain members which is located in one of the planes, whereas the same two portions bound a slot for receiving the other chain member which is located in the other of the planes. The recess for receiving the above one chain member is U-shaped, and the slot extends along the entire length of the chain block.

In such a construction the one chain member is located in the recess, and an end portion of this chain member is embraced by a wall bounding the recess, so that a very small specific pressure is applied to a supporting surface of the above wall of the recess, and thereby a very small shearing action and wear takes place, as compared with those in the known chain holding devices. At the same time it is also possible in this construction to so dimension the portions of the chain block which form the recesses for the chain members, that the chain members do not interfere with one another along the length of the chain and therefore along distances between the successive chain members. The stresses which act upon a single chain holding dog in the known holding devices are distributed in the proposed construction to both portions of the chain block. An additional advantage of the present construction is that the chain may practically be formed as a safety chain which is located between two chain blocks mounted on the end portions of the coal cutter, in which case there is no necessity to provide a guide bar or an additional safety chain extending between the chain blocks.

Another feature of the present invention is that the chain block has two supporting portions located adjacent to the U-shaped recess and at both sides of the slot so as to support the chain member which extends in a horizontal direction. This improves supporting of the respective member of the chain.

Still another feature of the present invention is that the chain block has two further such portions which are spaced from the first-mentioned portions in the direction of elongation of the chain block. The further two portions, similarly to the first mentioned portions, are formed with a further U-shaped recess and bound a further slot. The slots of both pairs of portions are formed as a common slot extending over the entire length of the chain block. In such construction the horizontally located chain members are inserted into the two U-shaped recesses bounding this chain member at both ends thereof, whereas the vertically located chain member is inserted in the common slot and held therein.

An additional feature of the present invention is that fastening means are provided for fastening the horizontal chain member to the chain block so as to prevent a displacement of this chain member in both directions of pulling of the chain. Such means may include fastening elements located adjacent to the U-shaped recess and operative for fastening of the horizontal chain member to the supporting portions of the chain block.

Still an additional feature of the present invention is that the chain block is of a rectangular, preferably square, cross-section, and that the recess and the slot are so located that their central planes coincide with respective diagonals of the cross-section of the chain block. When the cross-section of the chain block is square, the central planes of the recess and the slots are inclined relative to side margins of the chain block at an angle of 45°. The thus-constructed chain block is not heavy, it occupies the optimal place on the coal cutter and at the same time, has the maximum strength.

The other features which are considered as characteristic for the invention are set forth in particular in the appended claims. The invention itself, however, both as to its construction and its method of operation, together with additional objects and advantages thereof, will be best understood from the following description of special embodiments when read in connection with the accompanying drawings.

DESCRIPTION OF PREFERRED EMBODIMENTS

Figure 1:
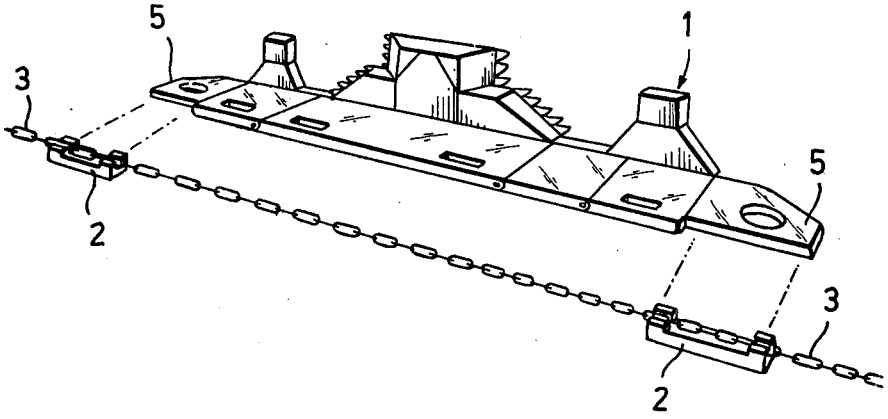
FIG. 1 is a perspective view of a coal cutter and a chain connectable therewith.

FIG. 1 shows a coal cutter 1 and chain blocks 2 for a chain 3 in accordance with the present invention.

The chain block 2 which can also be defined as a chain guiding block, has an elongated body part 4 which is mountable on a side portion of a body part 5 of the coal cutter 1. The body part 4 of the chain block 2 may be constituted of steel and produced by forgoing. It may be mounted on the body 5 of the coal cutter 1 by welding.

Figure 2:
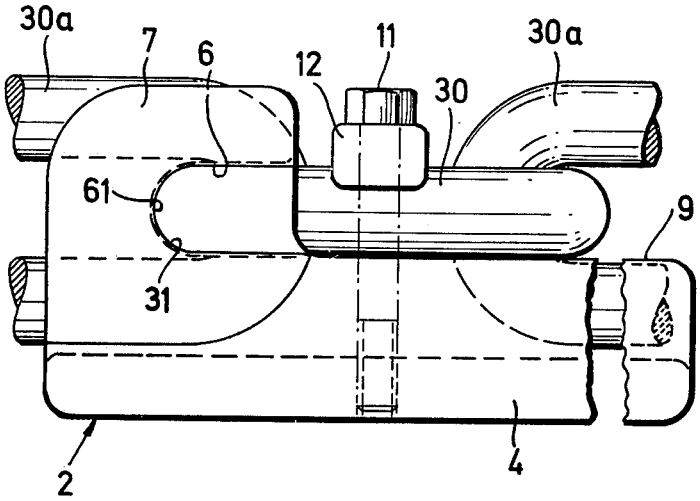
FIG. 2 is a side view of a chain block in accordance with one embodiment of the present invention.
Figure 3:
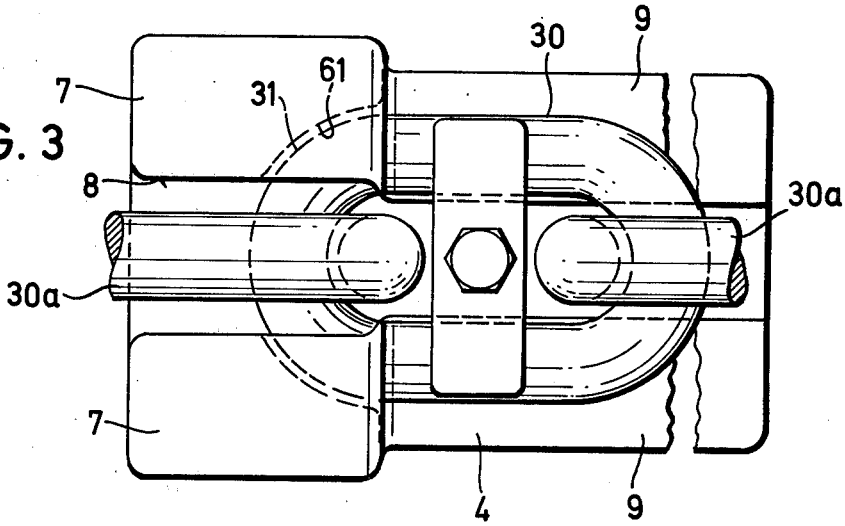
FIG. 3 is a plan view of the chain block shown in FIG. 2.
Figure 4:
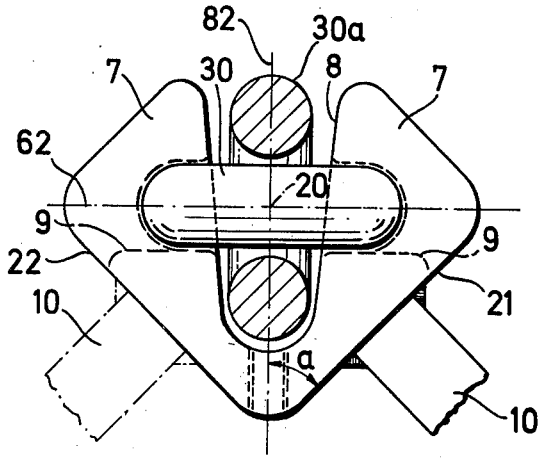
FIG. 4 is a transverse section of the chain block shown in FIG. 2.

As shown in FIGS. 2–4, the chain block 2 has two shaped side portions 7 which are identical but mirror-inverted with respect to one another. A substantially U-shaped recess 6 is formed in the portions 7 for receiving an end portion of a chain link 30 of the chain 3, which chain link is located in a horizontal plane. As shown in the drawing, the U-shaped recess 6 of the portions 7 has a shape which conforms to the form of an outer surface of a rounded portion 31 of the chain link 30. In this case the rounded portion 31 of the link 30 under the action of pulling force applied to the chain 3 is fully inserted in the U-shaped recess 6 in surface-to-surface contact with an inner surface of a rounded wall 61 of the U-shaped recess 6.

A slot 8 is bounded between the side portions 7. It extends in the direction of elongation of the chain block 2 and vertically beyond the recess 6 of the side portions 7. The slot 8 is substantially V-shaped and is dimensioned so as to receive a chain link 30*a* which is located transverse to the above mentioned chain link 30. The vertical chain link 30*a* can be inserted in the slot 8 and in this position does not interfere with the horizontal chain link 30. The slot 8 extends along the entire length of the chain block 2 so that the chain 3 can extend from a drive of the coal cutter 1 through both chain blocks 2 at both ends of the coal cutter 1, and then back to a drive of a chain. A swivel may be provided on the chain 3, if necessary.

As shown in FIGS. 2 and 3, supporting portions 9 may be further provided, which are located adjacent to the recess 6 at both sides of the slot 8. The supporting portions 9 extend along the entire length of the chain block 2 and can support one or several horizontal chain links 30. Means are further provided for fastening the chain 3 to the chain block 2. These means include a hold-down strap 12 which overlaps the horizontal chain link 30, and a threaded bolt 11. The threaded bolt 11 extends through a hole of the hold-down strap 12 and is screwed into a threaded bore 13 which is provided in a part located at a bottom of the slot 8. By screwing the threaded bolt 11 into the bore 13 the horizontal chain link 30 is firmly fastened to the body part 4 of the chain block 2.

Figure 5:
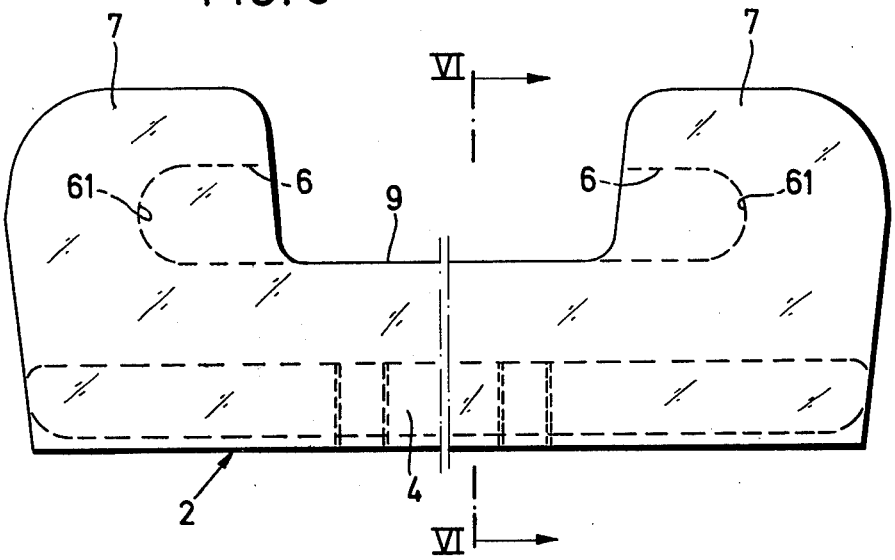
FIG. 5 is a side view of a chain block in accordance with another embodiment of the present invention.
Figure 6:
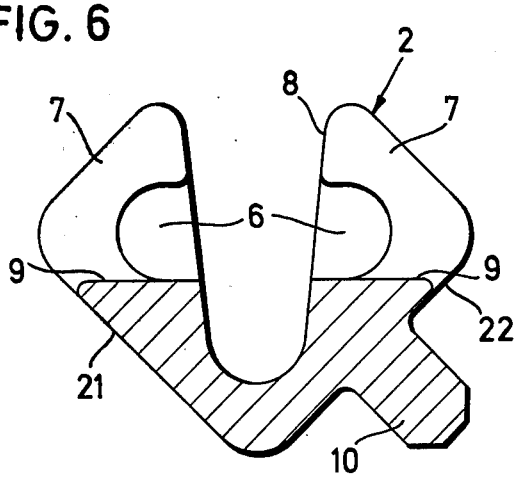
FIG. 6 is a transverse section of the chain block taken along the line VI—VI of FIG. 5.

FIGS. 5 and 6 show a chain block in accordance with another embodiment of the present invention. The parts of the chain block shown in FIGS. 5–6 which are identical to the parts shown in FIGS. 2–4 are identified with identical reference numerals. The chain block 2 in accordance with this embodiment of the invention, has two additional side portions 7 which are spaced from the first side portion in the direction of elongation of the chain block 2. An additional U-shaped recess 6 is formed in the additional side portions 7 and is open in a direction which is opposite to the direction in which the first U-shaped slot 6 of the first side portions 7 is open. The thus-formed two U-shaped slots 6 which are spaced from one another in the direction of elongation of the chain block 2, are adapted to receive the opposite end portions of the same horizontal chain link 30.

The horizontal supporting portions 9 extend along the entire length of the chain block 2 and at both sides of the slot 8. The slot 8 extends along the entire length of the supporting portions 9 and therefore also along the entire length of the chain block 2. The slot 8 is adapted to receive the vertical chain link 30*a*. The distance between two recesses 6 may be so dimensioned as to receive several, such as five or seven, links 30 and 30*a*. The slot 8 serves for simultaneously guiding the vertical chain link 30*a*.

The chain block 2 in accordance with both embodiments of the invention may be of a rectangular, preferably square, cross-section having rounded corners. The U-shaped recesses 6 and the slot 6 are so located with respect to one another and to side margins of the chain block that central planes 62 and 82 of the recesses 6 and the slot 8, respectively, coincide with mutually intersecting diagonals of the cross-section of the chain block 2. When the cross-section of the chain block is square, the central planes 62 and 82 of the recesses 6 and the slot 8, respectively, are inclined at an angle $\alpha$ of 45° relative to the respective side margins of the chain block, as shown in FIG. 4. The thus constructed chain block 2 is especially material economical and form stable, and can be used with known chains without taking much space.

It will be understood that each of the elements described above, or two or more together, may also find a useful application in other types of constructions differing from the types described above.

While the invention has been illustrated and described as embodied in a supporting device for a chain, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A holding device for a chain, particularly a chain associated with a coal cutter and having chain members located in two mutually transverse planes, the holding device comprising a one-piece chain block mountable on a support and having two portions which are of one piece with and immovable relative to each other, said chain block having a U-shaped recess formed in said relatively immovable two portions and dimensioned for receiving one end section of one of the chain members which is located in one of the planes without displacement of said two portions relative to one another and so that said end section is embraced by said two portions in said one plane at both sides of said end section and is also embraced by said two portions in said other plane at both other sides of said end section, said chain block further having a slot which is bounded by said relatively immovable two portions and located in the other of said planes and which is dimensioned for receiving the other chain member which is located in the other of said planes also without displacement of said two portions relative to one another.

2. The holding device as defined in claim 1, wherein said chain members are chain links.

3. The holding device as defined in claim 1, wherein said recess is pocket-shaped.

4. The holding device as defined in claim 1, wherein said portions are shaped portions.

5. The holding device as defined in claim 1, wherein said block is elongated, said portions being spaced from one another in a direction substantially transverse to the direction of elongation of said chain block.

6. The holding device as defined in claim 1, wherein the coal cutter has a body part forming said support, said chain block being mounted on the body part of the coal cutter.

7. The holding device as defined in claim 1, wherein said chain block is elongated and said slot extends in the direction of elongation of the chain block.

8. The holding device as defined in claim 1, wherein said chain block has a supporting element for supporting the one chain member.

9. The holding device as defined in claim 8, wherein the one chain member is located in a horizontal plane, said supporting element including two supporting portions located adjacent to said recess and a both sides of said slot.

10. The holding device as defined in claim 1, wherein said chain block is elongated and has other such two portions which are formed with another such U-shaped recess, bound another such slot and are spaced from said first mentioned portions in the direction of elongation of said chain block.

11. The holding device as defined in claim 11, wherein said U-shaped recess formed in said first mentioned portions is open in a direction towards said U-shaped recess formed in said other portions and vice versa, so that the other end section of the one chain member is received in said latter-mentioned U-shaped recess.

12. The holding device as defined in claim 10, wherein the one chain member is located in a horizontal plane, said chain block having two supporting portions for supporting the one chain member located adjacent to both said U-shaped recesses and at both sides of said slots.

13. The holding device as defined in claim 12, wherein said supporting portions extend along the entire length of said chain block.

14. The holding device as defined in claim 13, wherein said slots are formed as a common slot extending along the entire length of said chain block and formed between the portions of said two pairs of portions, and between said supporting portions.

15. The holding device as defined in claim 9, and further comprising means for fastening the one chain member to said supporting portions and located adjacent to said recess.

16. The holding device as defined in claim 15, wherein said fastening means include screw means.

17. The holding device as defined in claim 1, wherein said chain block is of a substantially rectangular cross-section having two mutually intersecting diagonals, said recess and said slot each having a central plane and being so located that the central planes thereof coincide with the respective diagonals of the cross-section of said chain block.

18. The holding device as defined in claim 1, wherein said chain block is of square cross-section, said central planes of said recess and said slot coinciding with the respective diagonals of said square cross-section of said chain block and intersecting one another at a right angle.

19. The holding device as defined in claim 18, wherein said chain block has side margins, said central planes of said recess and said slot being inclined relative to the respective side margin of said chain block at an angle of 45°.

20. The holding device as defined in claim 1, and further comprising a second such chain block spaced from the first mentioned block in the direction of elongation of the chain, said first mentioned and second block holding portions of the chain which are spaced from one another in the direction of elongation of the latter.

* * * * *